United States Patent [19]

Bonis

[11] 4,094,258

[45] June 13, 1978

[54] FUR GUIDE FOR A FUR-SEWING MACHINE

[76] Inventor: Caesar Bonis, Barkers Point Rd., Sands Point, N.Y. 11024

[21] Appl. No.: 736,891

[22] Filed: Oct. 29, 1976

[51] Int. Cl.[2] ..... D05B 23/00; D05B 35/00

[52] U.S. Cl. ..... 112/20

[58] Field of Search ..... 112/20, 16, 18, 19, 112/218 R

[56] References Cited

U.S. PATENT DOCUMENTS

| | | | |
|---|---|---|---|
| 2,588,281 | 3/1952 | Olday | 112/20 |
| 3,570,425 | 3/1971 | Shulman | 112/20 |
| 3,572,268 | 3/1971 | Olday | 112/20 X |

*Primary Examiner*—H. Hampton Hunter

*Attorney, Agent, or Firm*—Auslander & Thomas

[57] ABSTRACT

A sewing guide installable in a conventional fur-sewing machine head cover is also lock grippable in the sewing guide position.

11 Claims, 6 Drawing Figures

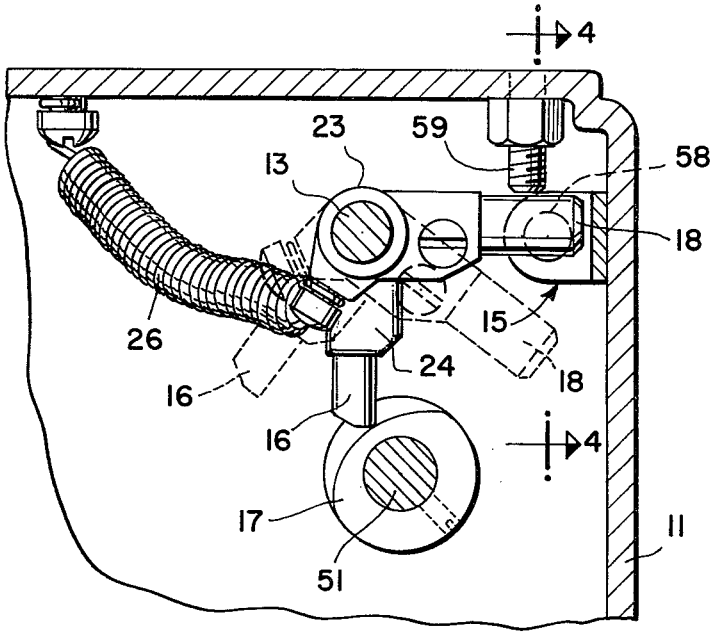
FIG.3
FIG.4
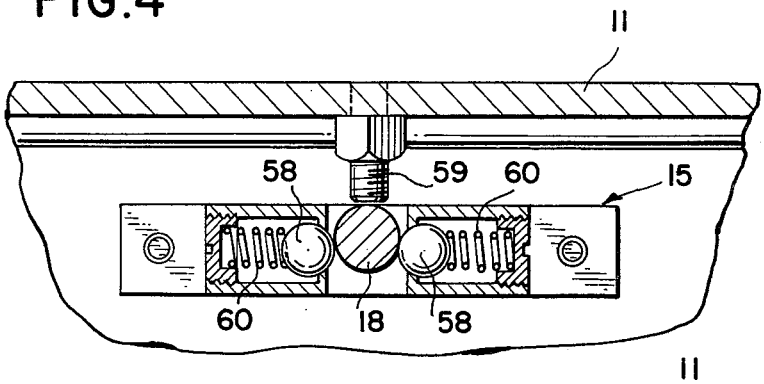
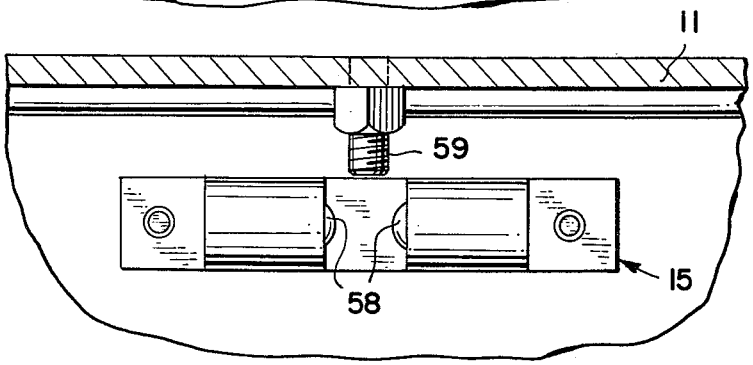
FIG.4A

FUR GUIDE FOR A FUR-SEWING MACHINE

The present invention relates to a fur guide for a fur-sewing machine particularly for new operators.

Because of the extreme amount of skill and time to train experienced operators to sew fur, many efforts have been made to provide simple means to guide fur into a conventional fur-sewing machine so that less experienced operators may be used to sew fur.

Guides in the sewing of fur are not the simple answer to rendering fur sewing easier. The fine hairs also have to be controlled so they are not sewn into the seams. Keeping the hairs out of the seams in a further skill even when guides are used.

The use of blowers to blow the hairs as the fur strips are being fed into the discs of the sewing machine has been used in the past separately or in combination with guides.

It has been desirable to provide fur-sewing machines that are capable of functioning normally and also as training machines. Thus, it is desirable that a machine that has guides and blowers may be used with or without the guide and blowers by an experienced or inexperienced operator.

Conversion of conventional fur-sewing machines has been done already. Such conversion as in U.S. Pat. No. 3,570,425 has been expensive and clumsy, usually requiring a new cover to be added to the head or a riser to be added.

Because blowers and guides are usually used by less experienced operators it is important that they be sturdy and finely adjustable and fully under control, to enable most effective utilization.

It is important to have guide means, particularly for training operators, that can be easily installed on a conventional fur-sewing machine in its usual head cover because of the economy of installability and ease of installation. Such guide is particularly useful further, when it is sturdy in its guide position and minutely adjustable for optimum use with any particular type of fur to be sewn.

According to the present invention, a guide means is provided installable in an existing conventional fur-sewing machine head cover and is lock grippable in sewing guide position.

Among the advantages of the present invention is its installability on fur-sewing machines of the prior art.

A ball spring clip grips a detent on the rocker arm to firmly hold the fur guide and air nozzle in its selected position.

A foot control locks the fur guide in its guide position held in the ball spring clip.

A simple cam on the shuttle arm disengages the fur guide rod as the conventional horizontal discs are separated.

A guide block is provided for adjustment of both the air nozzle and fur guide.

The air source for the nozzle has a flexible tube and an air valve and may be supported in the oil cup of the normal sewing machine bearing.

The air nozzle may be actuated at will before sewing is commenced.

Although such novel feature or features believed to be characteristic of the invention are pointed out in the claims, the invention and the manner in which it may be carried out, may be further understood by reference to the description following and the accompanying drawings.

FIG. 3 is a partial section of FIG. 2 at lines 3—3.

FIG. 4 is a section of FIG. 3 at lines 4—4.

FIG. 4A is a view of the ball spring clip of FIG. 4.

Referring now to the figures in greater detail, where like reference numbers denote like parts in the various figures.

Figure 1:
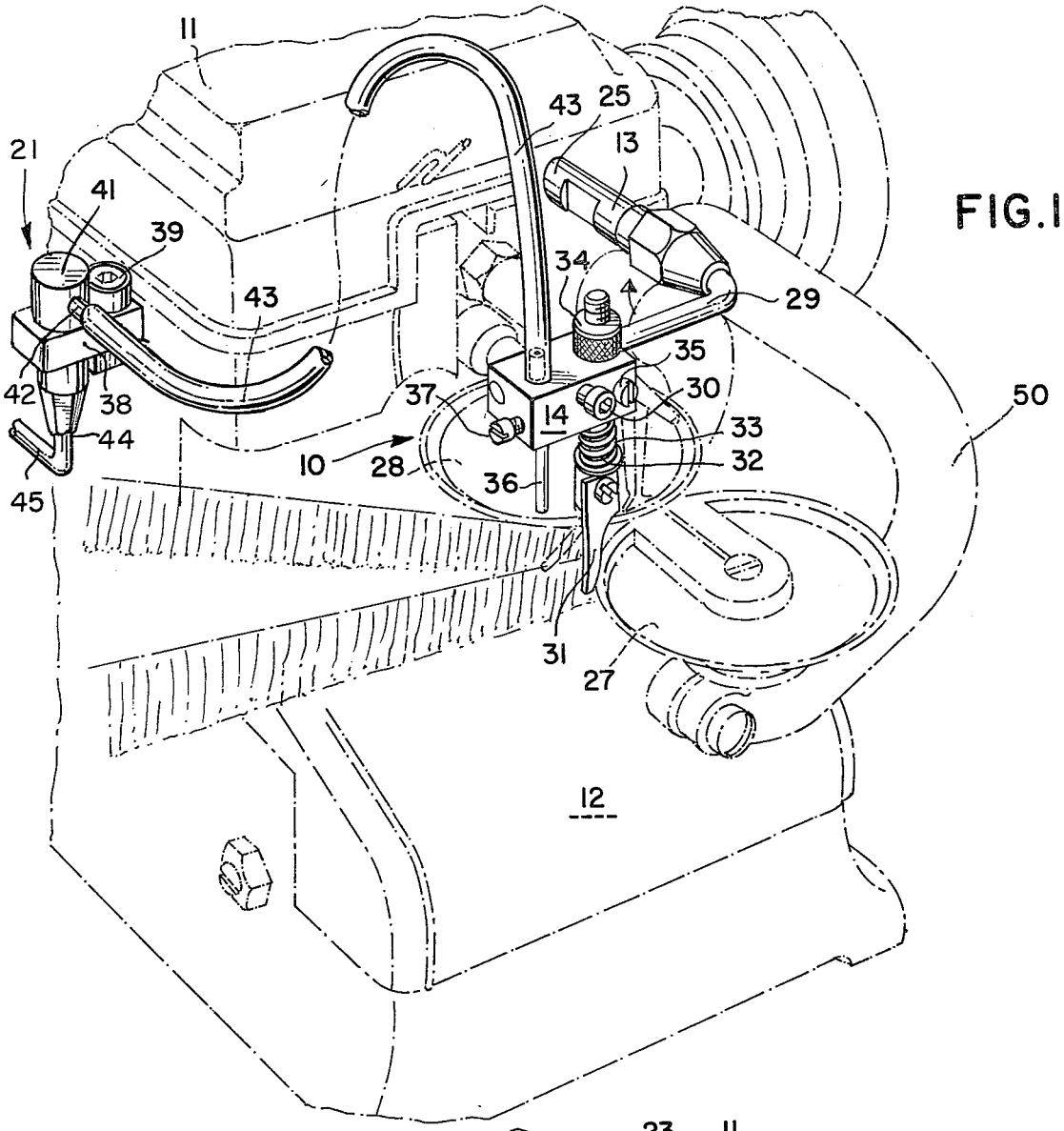
FIG. 1 is a partial perspective elevation of a fur-sewing machine with the guide of the present invention.

The fur guide system 10 is shown installed in the cover 11 of a conventional fur-sewing machine head 12 of the prior art in FIG. 1. Separately installable, the fur guide system 10 includes a rocker arm 13, a mounting block 14, a ball spring lock 15, a disengage detent 16, disengage cam 17, a position lock detent 18, a rocker arm lever 19, rocker arm actuating cable 20 and an air supply support unit 21.

The rocker arm 13 is engaged in openings (not shown) in the cover 11, rotatably held by a collar 22 on the rocker arm 13. Also mounted on the rocker arm 13 is another sleeve 23 including the position lock detent 18. A further sleeve 24 on the rocker arm 13 includes a disengage detent 16. Outside the cover 11 a position lock lever 19 engages the rocker arm 13 and extends to an engaging cable 20. It has been found convenient to have the lever, sleeves and collar 19, 24, 23, 22 screw mounted as shown. The rocker arm 13 is rotatably held in position outside the cover 11 by a flange 25, a part of the rocker arm 13 which interacts with the collar 22.

It is preferable to have the sleeve 23 biased by a spring 26 attached to the cover 11, biased to swing the unlocked rocker arm 13 clear of the horizontal discs 27, 28 of the sewing machine 12 and the sewing area.

The rocker arm 13 includes a right angle extension 29 upon which the mounting block 14 is set by Allen screw 30.

The block 14 includes the fur guide 31 on a flat-sided threaded shaft 32 biased by a spring 33. The spring 33 may be adjusted up or down by turning the knurled nut 34 and set by turning the set screw 35.

A nozzle 36 is also mounted in the block 14 and set and adjusted in selected position by use of set screw 37.

The air supply support unit 21 includes a bar 38 mounted into an oil hole (not shown) in the head 12 with an Allen screw 39. It is preferable that the Allen screw 39 have a hollow 40 so that the head can be conventionally oiled through the Allen screw 39.

An air valve 41 is mounted on the bar 38. There is an outlet 42 with a hose 43 running to the nozzle 36 and an inlet 44 with a hose 45 leading to a compressor 46 (shown in FIG. 5).

Figure 5:
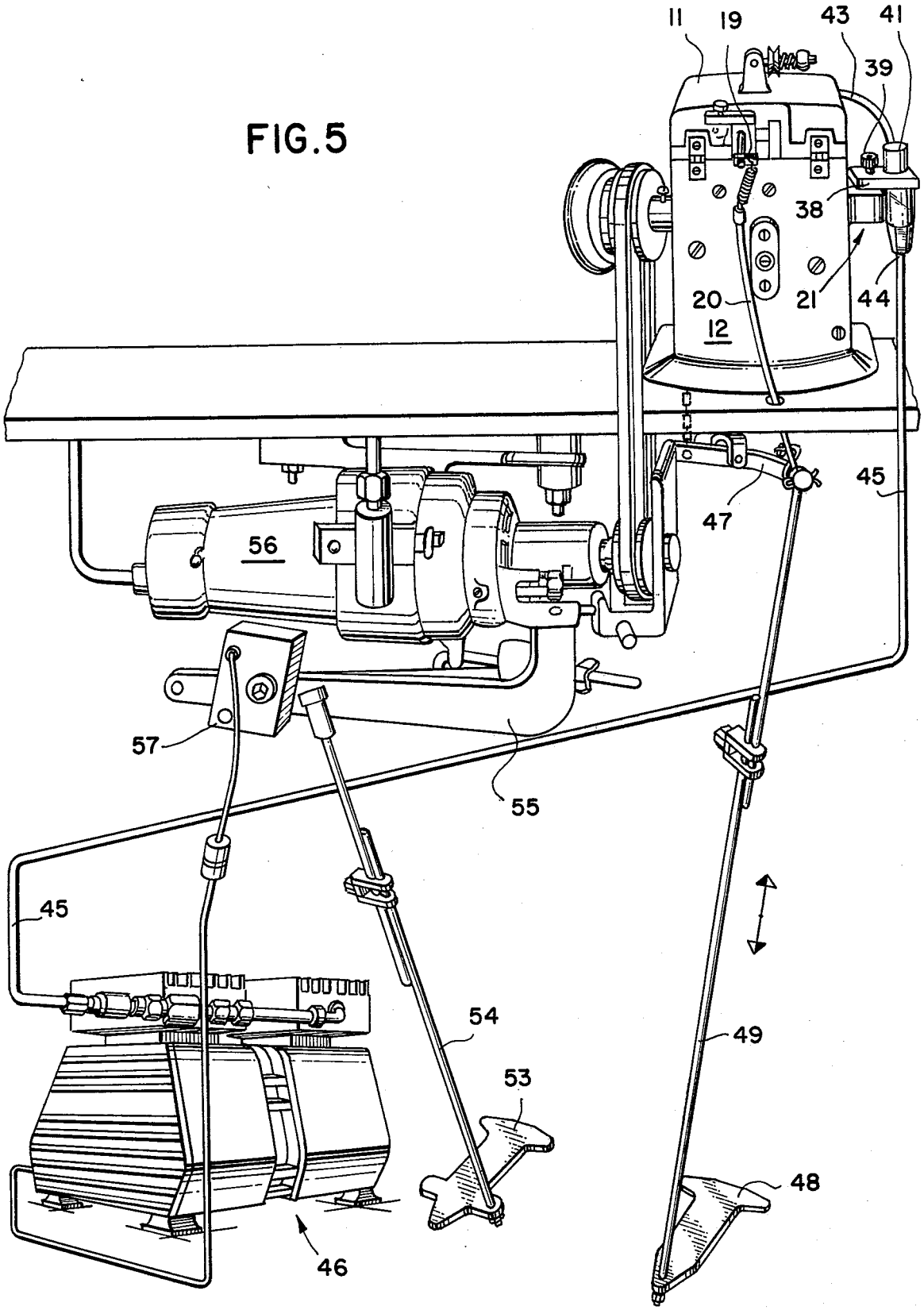
FIG. 5 is a schematicized view of the control systems of the present invention.

As shown in FIG. 5, one end of the rocker arm engaging cable 20 is looped around a lever arm 47. The lever arm 47 is also actuatable by a foot pedal 48 which impinges a rod 49 on the lever arm 47. The other end of the lever arm 47 is attached to the control mechanism (not shown) for actuating the disc support arm 50.

Figure 2:
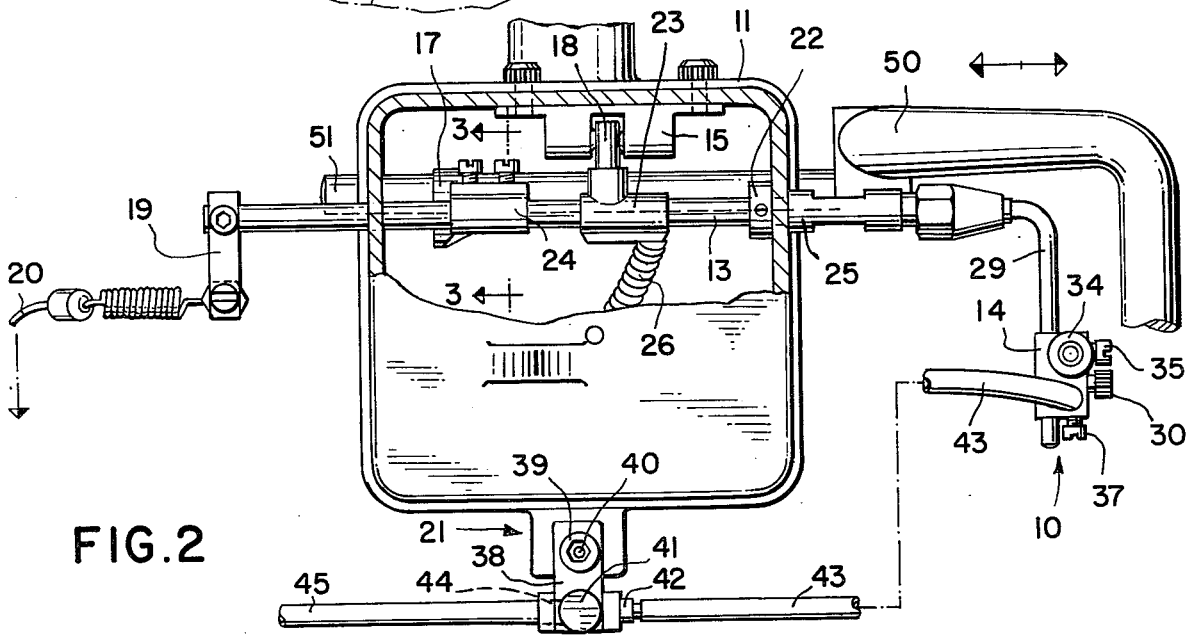
FIG. 2 is a partial cut-away plan view of FIG. 1.

In FIGS. 2 and 3 the shuttle arm 51 which is connected to the disc support arm 50 is shown with the cam 17 with a tapered face which is engageable with the disengage detent 16 on the sleeve 24.

A second foot pedal 53 actuates a rod 54 which connects to the control arm 55 of the sewing machine motor 56. Mounted on the control arm 55 is a microswitch 57 which controls the compressor 46. The microswitch 57 is preferably set so that the compressor may be actuated before the motor 56 starts. The initial depression of the pedal 53 actuates the microswitch 57 as the control arm 55 is moved before the motor 56 is started by further depression of the pedal 53.

In use the rocker arm 13 is installed in openings (not shown) in the cover 11 and held in position by the collar 22 and flange 25 with the mounting block 14 on the extension 29 in position for use with a hose 43 connected to the nozzle 36. The rocker arm engaging cable 20 is looped around the lever arms 47. The sleeves 23, 24 are adjusted in place and the cam 17 and ball spring lock 15 are set. The air supply support system 21 and hoses 43, 45 are connected and the microswitch 57 on the control arm 55.

In operation the operator desiring to use the guide, depresses the foot pedal 48. The rod 49 impinges on the cable 20 and rotates the rocker arm 13 into position by tugging the rocker arm lever 19. The detent 18 on the sleeve 23 is pushed past the locking balls 58 as shown in FIG. 4. The detent is firmly held against any movement once engaged. As shown in FIG. 3, it may be desirable to have a stop 59 to precisely hold the detent 18 against any movement.

It is important that the detent 18 be held firmly since its stability holds the fur guide 31 and nozzle 36 against undesired movement when in use. The springs 60 in the ball spring lock 15 further help to stabilize the rocker arm 13 and fur guide by holding the detent 18 firmly, once engaged. In FIG. 4A the ball spring lock 15 can be seen as it appears in place in the cover 11.

Once the fur is between the discs 27, 28, as shown in FIG. 1, the foot pedal 53 is slightly depressed. This actuates the microswitch 57 sending air through the nozzle 36. The nozzle 36 is precisely placed so that the air impinges on the hair of the fur, blowing it inward of the prospective seam.

A further depression of the foot pedal 53 actuates the motor 56. The fur is sewn and drawn forward with the sewing. A clean seam is made with all hair clear of the seam blown there by the air from the nozzle 36.

To reset the head 12 either to adjust the sewing, or place new fur in the machine 12, foot pedal 48 is depressed, impinging the rod 49 on the lever arm 47 which actuates the shuttle arm 51 which in its forward movement, spaces the disc 27 from the disc 28. As the shuttle arm 51 moves forward the camming surface on the cam 17 actuates the detent 16 which forces the release of the detent 18, thus swinging away the fur guide 31 and assembly. The spring 26 pulls the fur guide 31 and assembly clear of their working area.

The fur guide 31 and assembly are always under full control of the operator as well as the blower 36 for great ease of operation and minute adjustment for needed situations using set screws and nuts 30, 34, 35, 37, etc.

The terms and expressions which are employed are used as terms of description; it is recognized, though, that various modifications are possible.

It is also understood the following claims are intended to cover all of the generic and specific features of the invention herein described, and all statements of the scope of the invention which, as a matter of language, might fall therebetween.

Having described certain forms of the invention in some detail, what is claimed is:

1. A sewing guidance system installable in the conventional cover of the head of a fur-sewing machine, said sewing guidance means comprising a fur-sewing machine head, a head cover, a rocker arm, said rocker arm rotatably mounted in said head cover, said rocker arm adapted to rotate to a sewing guide position and to rotate away from said sewing guide position, said rocker arm including spring means, said spring means normally biasing said rocker arm away from said sewing guide position, means to hold said rocker arm in said sewing guide position, means on said rocker arm to mount a fur guide and a blower nozzle, air compression means, means connecting said air compression means with said nozzle, means to actuate said air compression means, cam means on said rocker arm adapted to selectively interact to release said rocker arm from said sewing guide position, cam means in said head adapted to selectively interact with said rocker arm cam means when said rocker arm is held in said sewing guide position to effect said rocker arm release, means to selectively rotate said rocker arm to said sewing guide position, motor means, said motor means adapted to selectively actuate said sewing machine, said motor actuating means and air compression actuating means being a single foot pedal, said air compression means being individually actuatable first, another foot pedal means to rotate said rocker arm to said sewing guide position, said other foot pedal means including means to actuate said cam means in said head to interact with said rocker arm cam means to release said rocker arm from said sewing guide position, and said means to hold said rocker arm in sewing guide position being two-part interlockable means, one part of said interlockable means being on said rocker arm and the other part of said interlockable means being in said head cover, said two-part interlockable means including a detent and a grasp means.

2. The invention of claim 1 wherein said holding means is a spring ball lock.

3. The invention of claim 2 wherein said detent is rotatably set on said rocker arm and said spring ball lock is set in said cover including a stop in said cover.

4. The invention of claim 3 including an air valve.

5. The invention of claim 4 wherein said air valve is mounted on said sewing machine head.

6. The invention of claim 5 wherein said air valve is mounted in an oil cup in said head.

7. The invention of claim 6 wherein said mounting means includes a hollow opening into said oil cup.

8. The invention of claim 1 wherein said fur guide and blower nozzle are mounted on a unitary mounting means.

9. The invention of claim 8 wherein said fur guide and blower nozzle are adjustable in said mount.

10. The invention of claim 5 including flexible hose means from said air valve to said blower nozzle and hose means from said air valve to said air compression means.

11. The invention of claim 1 wherein said air compression actuation means is a microswitch.

* * * * *